US009917409B2

(12) United States Patent
Fischer

(10) Patent No.: US 9,917,409 B2
(45) Date of Patent: Mar. 13, 2018

(54) METHOD FOR PRODUCING A CRIMP CONNECTION

(71) Applicant: KOMAX Holding AG, Dierikon (CH)

(72) Inventor: Daniel Fischer, Lucerne (CH)

(73) Assignee: KOMAX HOLDING AG, Dierikon (CH)

( * ) Notice: Subject to any disclaimer, the term of this patent is extended or adjusted under 35 U.S.C. 154(b) by 82 days.

(21) Appl. No.: 15/180,149

(22) Filed: Jun. 13, 2016

(65) Prior Publication Data

US 2016/0294142 A1 Oct. 6, 2016

Related U.S. Application Data

(62) Division of application No. 14/071,730, filed on Nov. 5, 2013, now Pat. No. 9,373,924.

(30) Foreign Application Priority Data

Dec. 3, 2012 (EP) ..... 12195299

(51) Int. Cl.
*H01R 43/055* (2006.01)
*H01R 43/048* (2006.01)

(52) U.S. Cl.
CPC ..... *H01R 43/055* (2013.01); *H01R 43/048* (2013.01); *Y10T 29/49183* (2015.01); *Y10T 29/53235* (2015.01)

(58) Field of Classification Search
CPC ..... H01R 43/048; H01R 43/055; Y10T 29/49183; Y10T 29/53235
See application file for complete search history.

(56) References Cited

U.S. PATENT DOCUMENTS 4,171,566 A * 10/1979 Tominoi ..... H01R 43/04 29/564.4
4,653,159 A * 3/1987 Henderson ..... H01B 13/01245 140/93 R
4,862,587 A 9/1989 Nakata et al.
4,916,811 A * 4/1990 Uehara ..... G02B 6/3855 140/92.2
5,119,546 A * 6/1992 Cameron ..... H01R 43/048 29/705
5,224,251 A * 7/1993 Cameron ..... H01R 43/052 29/33 M
5,327,644 A * 7/1994 Tanaka ..... H01R 43/05 29/33 M (Continued)

FOREIGN PATENT DOCUMENTS

EP 1341269 A1 9/2003
EP 1667289 A1 6/2006
WO 2006136930 A1 12/2006

*Primary Examiner* — Carl Arbes
(74) *Attorney, Agent, or Firm* — Williams J. Clemens; Shumaker, Loop & Kendrick, LLP

(57) ABSTRACT

A method for producing a crimp connection includes a mobile supply unit that can be connected with a crimping press station for storing and supplying crimp contacts to the crimping press station. The mobile supply unit is loaded with two supply rolls with crimp contacts that can be attached laterally to the mobile supply unit. Each supply roll is assigned to a respective coupling device by which the supply unit can be connected in two docking locations with the crimping press station and disconnected from the docking locations.

7 Claims, 5 Drawing Sheets

(56) References Cited

U.S. PATENT DOCUMENTS

| | | | | |
|---|---|---|---|---|
| 5,537,741 | A * | 7/1996 | Peterson | G05B 19/41805 29/33 F |
| 5,765,287 | A | 6/1998 | Koike et al. | |
| 6,067,828 | A | 5/2000 | Bucher et al. | |
| 6,490,785 | B1 * | 12/2002 | Kometani | H01R 43/01 29/33 M |
| 6,961,992 | B2 | 11/2005 | Conte | |
| 7,080,450 | B2 * | 7/2006 | Deming | H01F 41/10 140/102 |
| 7,152,310 | B2 | 12/2006 | Conte | |
| 7,603,768 | B2 | 10/2009 | Viviroli | |
| 7,870,662 | B2 * | 1/2011 | Imai | H01R 43/20 29/747 |
| 8,176,626 | B2 | 5/2012 | Kirst | |
| 2004/0007042 | A1 | 1/2004 | Imgrut et al. | |

* cited by examiner

METHOD FOR PRODUCING A CRIMP CONNECTION

CROSS-REFERENCE TO RELATED APPLICATION

This application is a divisional of the co-pending U.S. patent application Ser. No. 14/071,730 filed Nov. 5, 2013.

FIELD

The invention relates to a method for producing a crimp connection.

BACKGROUND

Crimping involves the production of a non-detachable electrical and mechanical connection (subsequently referred to as "crimp connection") by means of plastic deformation between a conductor and a crimp contact. Devices and methods for assembling electric cables in which the cables are stripped and then in a crimping press a crimp contact is produced on the stripped conductor end of the cable are well-known and have been in use for a long time. In industrial production, it is customary during the crimping process to process contact strips with crimp contacts strung together, wherein the contact strips are wound on a supply roll. Often, the contact strip is provided with a carrier strip which consists, for example, of paper which separates when wound the individual layers of contact strips with the crimp contacts.

The patent document EP 1 341 269 A1 disclosed a crimping press station that is designed as a rotary table press. The crimping press station has a crimping press and a rotating disc-shaped tool table on which three tool tables have been arranged. Each tool table has been provided with a supply roll of crimp contacts and a winder for receiving the carrier strips removed from the contact strips. With this device, it is possible to process different crimp contacts. The device also offers the possibility of operating successively different contact types with short downtimes. However, the device is complex and comparatively expensive.

The patent document DE 20 2006 020927 U1 shows a further device for producing a crimp connection. The device comprises a crimping press station which can be connected with a contact supply unit, which has a supply roll for the contact strip with the crimp contacts, and a paper web winder. Several contact supply units can be stored in a separate storage rack. The individual contact supply units have to be removed from the storage rack and inserted in the crimping press station. The exchange process or process of retooling the machine with different crimp contacts is difficult and requires quite some skills on the part of the operator of the machine. Furthermore, such processes result in extensive downtimes which have a negative effect on productivity.

A device of the above-mentioned type has been disclosed in the patent document U.S. Pat. No. 8,176,626 B2. The device comprises a supply unit for storing and supplying the crimp contacts to a crimping press station which can be moved simply by pushing or pulling transport wheels. The mobile supply unit has vertical walls spaced apart from one another. A supply roll and a paper winder are respectively swivel-mounted between said walls. Experience has shown that with regard to efficiency and productivity the device does not meet higher standards. For example, extensive downtimes can occur when a supply roll with the crimp contacts becomes empty. In this case, the old or empty supply roll has to be removed and a new or full supply roll has to be installed. The contact strip has to be threaded again. The previously wound carrier strip paper has to be removed and the paper web of the new supply roll is fixed on a new winder. Changing the supply roll requires also removing the axis. A further disadvantage involves the fact that it is very difficult to access the winder for the carrier strip.

SUMMARY

Therefore, it is an objective of the invention to provide a device of the type mentioned above which is easy to handle and which allows for efficient operation, especially with regard to the downtimes.

Since the supply unit is designed in mobile fashion it can be simply moved to the crimping press station, wherein the supply unit is preferably designed to be moveable. When not in use it could be placed at a separate storage place. For mobility the supply unit could be provided with transport rolls or wheels. Preferably, the wheels or rolls are freely rotating so that a person operating the supply unit can push or move it in all directions. It is also possible to use a model in which the means of transport are motor-driven, whereby the supply unit could be moved without using physical strength.

The means of transport, for example, the transport rolls or wheels, can be an integral part of the supply unit. Alternatively, it is also possible to design the supply unit as a two-part construction. In this case the supply unit would consist of a separate moveable carriage, which includes the means of transport, and a part that can be mounted on top of the carriage. To be able to efficiently unwind or pull the contact strips with the crimp contacts, the supply rolls are stored in the supply unit in such a way that they can each be rotated independently.

The mobile supply unit can have coupling means assigned to each supply roll for forming a connection to the crimping press station. Therefore, in a simple manner the supply unit is able to provide two docking locations. The device minimizes the downtime of the machine when changing the contact material. For example, the retooling process can be achieved in an especially easy manner when the supply rolls have different crimp contacts. With the device, it is possible to select at least two docking locations and thus supply crimp contacts to the crimping press station from one of the at least two supply rolls. One contact supply is used in the currently running crimping press station, while the other contact supply can be prepared and processed by the operator without stopping the crimping press station.

In one embodiment the mobile supply unit can have at least two roll mountings for preferably freely rotating supply rolls from each of which crimp contacts or contact strips with crimp contacts can be pulled. For example, the roll mountings of the mobile supply unit can consist of bearing pins to which each supply roll can be laterally attached. The bearings of the supply rolls can be designed to match the bearing pins. However, alternatively it is also possible to provide the supply rolls with bearing pins. In this case, the mobile supply unit would have bearings that can be attached to the bearing pins assigned to the supply rolls. The fact that the supply unit can be loaded from different sides with supply rolls further improves the manageability and productivity of the device.

The mobile supply unit can comprise a support member extending in vertical direction. At the same time, the roll mounting, for example, the above-mentioned bearing pins, can be arranged on opposite side walls of the support member. As a result, the bearing pins would run in opposite directions or protruding away from one another.

Furthermore, it can be advantageous when the mobile supply unit comprises at least two motor-driven winders to wind up a carrier strip removed from the contact strip. For each supply roll or each roll mounting, a respective winder can be assigned or provided for the storage of a supply roll. Each of the winders can be laterally attached to respective bearing seats, allowing for a simple and fast process of loading and unloading the supply unit with winders.

For each supply roll or each roll mounting, the mobile supply unit can have a coupling device, respectively, for storing a supply roll, by means of which coupling device the supply unit can be temporarily docked or connected in a docking location with the crimping press station. With at least two such coupling means the mobile supply unit can be used in many different ways.

It is especially preferred when the mobile supply unit comprises two coupling devices, which are situated opposite of one another when viewed from the top. With this embodiment the mobile supply unit must only be rotated by 180° or moved in order to be transferred from the first docking location to the second docking location. In addition, this embodiment has the advantage of being especially accessible for re-tooling and other work in connection with the supply roll not used for crimping.

A further embodiment is characterized in that the mobile supply unit can be docked or connected with the crimping press station by means of a quick connector, wherein the quick connector can have at least one latch mechanism or a mechanism for forming a snap-on connection, respectively. Alternatively, the mobile supply unit can be connected with the crimping press station in form-fit and/or frictionally engaged manner, respectively. In this way, the mobile supply unit can be connected with the crimping press station in a simple and secure manner.

Preferably, the quick connector can have a latch mechanism preloaded by springs and at least one pin that can be locked against a preload force behind corresponding counter bearings. Alternatively, or even additionally, the quick connector can have at least one clamping element preloaded by springs and, preferably, with the possibility to switch between an open and closed position. In closed position, the clamping element adheres to a counterpart and secures the mobile supply unit in its position in the docking location. The latch can have at least one indentation. In this case, it can be advantageous when in closed position the at least one clamping element engages in the indentation, thus achieving an especially secure connection between supply unit and crimping press station in the docking location.

The crimping press station can have an unlocking lever which is actively connected with the coupling devices assigned to at least two supply rolls and by means of which the respective docking locations can be unlocked. It is also possible to assign the unlocking mechanisms to the mobile supply unit. For example, each coupling device would have one unlocking lever for unlocking the respective docking location.

Advantageously, the coupling devices can be adjusted in height in order to adjust different heights of machine tables of the crimping press station.

For each supply roll having contact strips with contacts strung together or each roll mounting for storing a supply roll, the mobile supply unit can have guidance means for guiding the contact strips away from the supply rolls in a controlled manner. At the same time, the guidance means assigned to a respective supply roll can be arranged in the supply unit in such a way that the contact strips of the changeover of the supply rolls can be pulled in opposite conveying direction.

The mobile supply unit can have at least two tool storage places for placing a crimping tool in parking position. Each tool storage place has been assigned, respectively, a supply roll or a roll mounting for storing a supply roll. For the crimping process, the respective crimping tool would have to be placed in the crimping press station (in operating position).

The crimping press station can have two crimping presses and can be designed in such a way that at least two mobile supply units can be connected with the crimping press station. Each crimping press can be connected with one supply unit, respectively. With such an arrangement, the productivity of the invention-based device can be considerably increased.

The individual supply rolls can be provided with an identification number that can be read manually or by a machine, wherein the prepared material can be identified and tracked at any time and confusion between the supplies of a mobile supply unit or between different mobile supply units can be avoided. This information can be read by the device. When there are differences in data or identity, the crimping press station can sound an alarm and/or stop production.

The invention can be directed also to a mobile supply unit involving the device for producing a crimp connection described above. Such a supply unit could perhaps be used with existing conventional crimping press stations. For example, it could be advantageous to use the mobile supply unit described above as crimping press station in conjunction with the crimping machine described in the patent document DE 20 2006 020927 U1.

A further aspect of the invention relates to the method of producing a crimp connection, especially by using the device described above. Basically the method comprises the following steps: connecting a mobile supply unit for storing and supplying crimp contacts with a crimping press station in a first docking location; connecting conductor ends of cables with crimp contacts in the crimping press station, wherein the crimp contacts of a first supply roll of the mobile supply unit are guided as contact strips with crimp contacts strung together to the crimping press station; loading the mobile supply unit with a second supply roll; and (for example, in the case of an empty supply roll or when changing to a different crimping material) disconnecting the mobile supply unit present in the first docking location from the crimping press station and connecting said supply unit with the crimping press station in a second docking location. Thereafter conductor ends of cables are connected in the crimping press station with crimp contacts supplied by the second supply roll. To transfer the supply unit from the first docking location to the second docking location, it is only necessary to move the mobile supply unit by means of transport wheels or other means of transport.

When changing materials, the operator can take the first crimping tool from the crimping press and place it on the appropriate tool storage place. Subsequently, he can open the quick connector, for example, with the unlocking lever, pull the supply unit back, rotate it by 180° and fix it by means of the quick connector on the crimping press station in order to establish the second docking location. Preferably, the contact strip has already been threaded in the second crimping tool and the paper or carrier strip has been clamped in the paper winder. As a result, the operator merely has to place the new crimping tool in the crimping press and, preferably, lock it for reasons of security. This reduces the downtime for changing the crimping material to unloading the old or first crimping tool from the crimping press and loading the new or second crimping tool on the crimping press. All other steps can be performed during the inactive supply while the machine (crimping press station) is running.

When the mobile supply unit comprises two coupling devices which are situated opposite of one another when viewed from the top, the mobile supply unit can be transferred from the first docking location to the second docking location (or vice versa) merely by a 180° rotation.

DESCRIPTION OF THE DRAWINGS

Further advantages and individual characteristics are demonstrated in the subsequent description of the embodiments and drawings. It is shown.

DETAILED DESCRIPTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
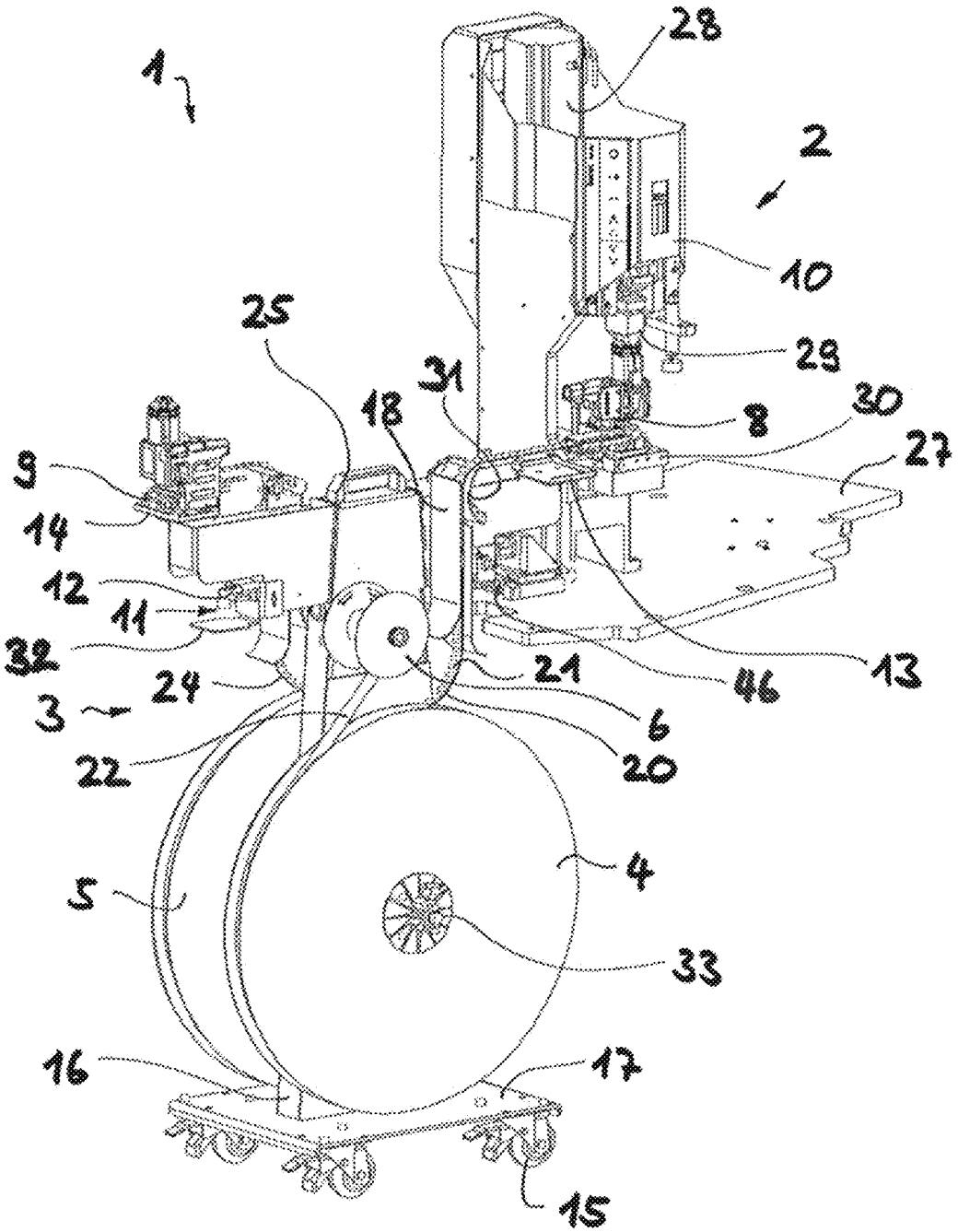
FIG. 1 is a perspective view of an invention-based embodiment for producing a crimp connection with a crimping press station and a connected mobile supply unit.

FIG. 1 shows a device denoted as a whole with 1 for producing a crimp connection by means of a crimping press station 2 and a disconnected mobile supply unit 3 for storing and supplying the crimping press station 2 with crimp contacts 21. The crimping press station 2 comprises a crimping press 10 mounted on a machine table 27, by means of which crimping press 10, a stripped conductor end of a cable can be connected with a crimp contact. For example, the machine table 27 has been fixed with a supporting structure (not shown) to a floor, thus making the crimping press station 2 stationary. In the crimping press station 2, cables that are already stripped can be processed. However, the crimping press station can also be part of a machine for assembling electric cables which comprises a stripping station in addition to the crimping press station. During the crimping process, the crimp contact at the very front of the contact strip is separated and pressed together with the conductor end of the cable. The crimping press 10 has a tool holder 29 that can be driven by a motor 28 and moved back and forth in vertical direction. A crimping tool 8 has been placed between the tool holder 29 and a panel of the crimping press. The crimping tool 8 comprises an anvil and a crimp indentor for producing the crimp connection. Experts are familiar with crimping presses of this type or comparable crimping presses and crimping tools. For example, the patent document EP 1 341 269 A1 provides exemplary information with regard to the structure and mode of operation of crimping press and crimping tools. The present device is especially characterized by the practical supply unit 3 for storing and supplying crimp contacts 21 to the crimping press station 2 and by a special interface between supply unit and crimping press station, which is subsequently described in more detail.

The mobile supply unit 3 can be disconnected and removed from the fixed crimping press station 2. Preferably, the crimping tool 8 shown in FIG. 1 in operating position is removed from the crimping press 10 prior to the move and placed in parking position on a tool storage place 13 assigned to the mobile supply unit 3 (see also subsequent description of FIG. 2). The mobility of the supply unit 3 is ensured by a carriage having transport wheels 15. The supporting surface for the transport wheels 15 can involve, for example, the floor of a machine shop. The four transport wheels 15 are attached to the bottom surface of a base plate 17 which is connected with a support member 16 that extends in vertical direction. Two supply rolls 4, 5, respectively, are laterally arranged at the central support member 16. Said supply rolls 4, 5 can be rotated independently by means of roll mountings 33. The supply rolls 4, 5 comprise contact strips 20 with crimp contacts 21 strung together. From the supply roll 4 shown in FIG. 1, the contact strip 20 is guided past guidance means 18, 19 (FIG. 2), 31 to the crimping press 10 with the crimping tool 8 placed into it. When the contact strip 20 is pulled off, the carrier strip 22 is wound up by a motor-driven winder 6. The second supply roll 5 is in standby position. For an efficient operation of the device, and especially for the shortest possible process of retooling, the contact strip 24 of the supply roll 5 is guided already to the second crimping tool 9 which is located in parking position on the second tool storage place 14. Compared with the first supply roll 4, the supply roll 5 can be filled with similar or different crimp contacts. When exchanging the crimp contacts, the crimping tool 9 merely has to be placed into the crimping press of the crimping station because the contact strip 24 has already been threaded. The opposite area with the second supply roll 5 and the components assigned to the second supply roll, such as winder and crimping tool 9, can (because of being inactive) be safely and simply prepared with regard to a potential change of material.

Thus, it is possible with the mobile supply unit 3 to achieve two docking locations, each being assigned to a supply roll. In order to transfer from the first docking location shown in FIG. 1 to the second docking location, the supply unit 3 has to be disconnected, moved away and rotated about the vertical axis by 180°. To prepare the second docking location, the mobile supply unit 3 has a coupling device 11 which is designed in the same way as the coupling device for connecting with the crimping press station located on the opposite side and assigned to the first supply roll 4. For connecting the mobile supply unit 3, the crimping press station 2 has two clamping elements 46 preloaded by springs and can be moved between an open and closed position by means of an unlocking lever. Said clamping elements 46 act on a counterpart assigned to the mobile supply unit 3 in order to secure the docking location. The second supply roll 5 has such an exposed counterpart, which is designed in the form of a latch 32. In its rear part the latch 32 is tapered on both sides, thus forming an indentation, respectively. In closed position, the clamping elements 46 cover the latch 32 in the region of the indentations, thus preventing that the mobile supply unit is accidentally removed from the crimping press station. However, it is also possible to use different connection alternatives instead of the exemplary quick connector with the clamping elements that cover the latch 32 in closed position. For example, the quick connector for creating a snap-on connection could have at least a preloaded pin that interacts with a counter bearing (for example, locking pin) of the coupling device of the supply unit. The latch mechanism would have the advantage that merely by insertion a secure docking location could be achieved. It is also possible to use friction-type connections. For example, the latch could be clamped between two clamping parts that can be moved in sandwich-like fashion in relation to one another. The mobile supply unit comprises two similarly designed coupling devices 11 which are situated opposite of one another when viewed from the top, wherein each coupling device 11 is assigned to a supply roll 4, 5, respectively, for creating a docking location. Both coupling devices designed as quick connectors are situated opposite of one another when viewed from the top.

Above the latch 32, a plug connector 12 is located in order to create an electric connection between crimping press station and supply unit 3 for operating the winder and the light barrier, which is subsequently explained in more detail. In addition to transferring the control signals and feeding the motors for the winders, this electric connection allows also for an identification of the supply units. Therefore, the device 1 makes it possible with minimum downtimes to run in succession several different types of crimp contacts. When with large batches of the same type of contacts the supply of crimp contacts of a supply roll runs out, it is possible to quickly switch to the new supply of contacts of the opposite supply roll. By means of the quick connect coupling, the device can monitor whether or not crimp contacts are actually supplied to the crimping press station. It can thus be concluded whether a change of material is required, whereupon the crimping press station can request from the user, for example, by transmitting visual or acoustic signals, appropriate measures like, for example, the verification of the barcodes of the supply roll or newly teaching the crimping press, wherein a new calibration of the crimp force monitoring after a change of supply rolls is performed during the teaching process.

Figure 2:
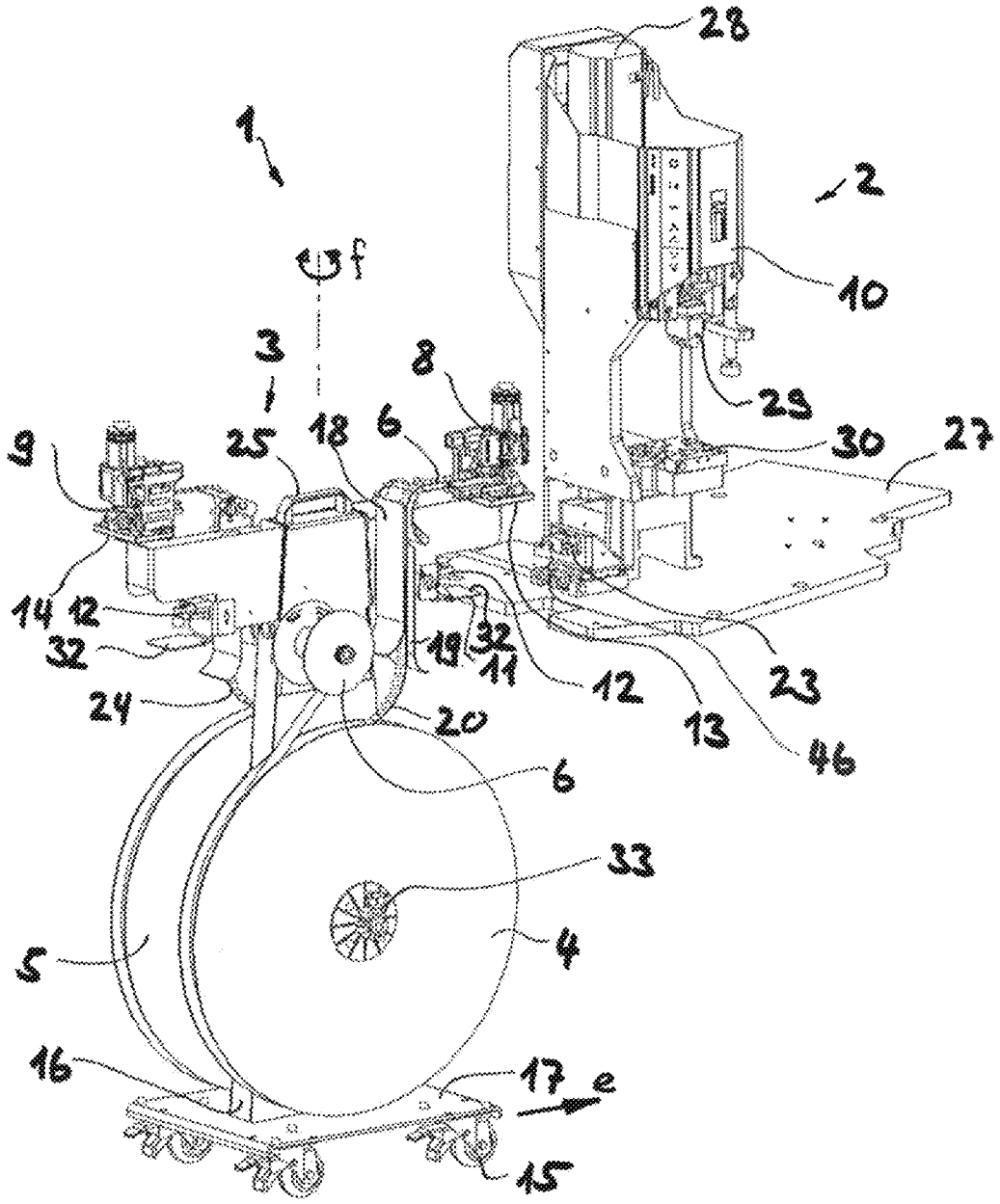
FIG. 2 is the device shown in FIG. 1 but with a mobile supply unit that has been disconnected and slightly removed from the crimping press station.

FIG. 2 shows the device 1 with a mobile supply unit 3 that has been disconnected and slightly removed from the crimping press station. For example, a socket 23 is on the station 2 into which the respective plug connectors 12 of the mobile supply unit can be inserted for creating an electric plug connection. In the device 1 shown here, both crimping tools 8, 9 are positioned respectively on the tool storage places 13, 14. The tool storage places 13, 14 are provided with a collar, which prevents the crimping tools 8, 9 from falling down. For this purpose, the tool storage places can be equipped also with magnets. By moving the mobile supply unit 3 in the direction of displacement, which is indicated with an arrow e, the supply unit could be transferred to the first docking location. The crimping tool 8 has to be simply placed on the panel 30 of the crimping press 10 to produce the crimp connections. The mobile supply unit 3 can be rotated by 180° and then connected in analogous manner with a second docking location. The rotary motion is indicated by an arrow f. In the second docking location, contact strips 24 are removed from the second supply roll 5 and supplied to the crimping press 10.

Basically, the device 1 can be described as follows: first the mobile supply unit 3 is connected with the crimping press station 2 (first docking location). Then the conductor ends of the cables can be connected with crimp contacts 21 in the crimping press station 2. In the process, the crimp contacts of a first supply roll 4 are guided as contact strips with crimp contacts strung together to the crimping press station 2 with the crimping press 10. Prior to or during the above-mentioned first crimping process using the crimp contacts of the first supply roll 4, the mobile supply unit 3 is supplied with the second supply roll 5. For example, when the first supply roll 4 is empty, the mobile supply unit 3 is disconnected from the crimping press station 2, slightly moved backwards and then rotated by 180°, whereupon the mobile supply unit 3 is connected with the crimping press station 2 for preparing the second docking location. Because of the quick connector, it is easy to secure the docking locations. Thereafter, the conductor ends of the cables can be reconnected with crimp contacts in the crimping press station 2, wherein the crimp contacts now originate from the second supply roll 5.

Figure 3:
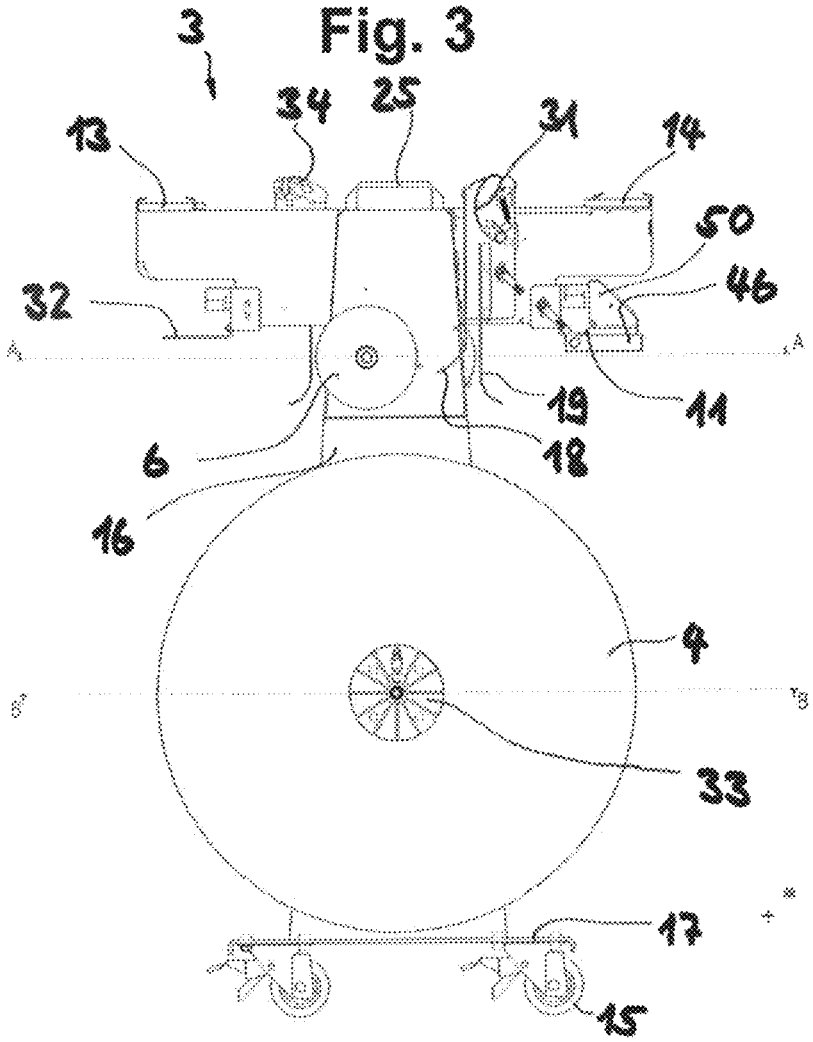
FIG. 3 is a lateral view of the mobile supply unit shown in FIG. 1.

FIG. 3 shows a lateral view of the mobile supply unit 3 for storing and supplying crimp contacts to the crimping press station. Of the crimping press station, the picture merely shows the negative feedback means with the clamping elements 46 for connecting with the mobile supply unit. FIG. 3 indicates the first docking location in which the coupling device 11 of the supply unit 3 engages with the coupling means of the crimping press station. Especially the clamping element 46 of the coupling means of the machine is clearly visible. The latch 32 of the coupling device 11 can be inserted into a mounting which is equipped with clamping elements 46 preloaded by springs.

The contact strip guide has fixed guiding plates 18, 19 and a rocker 31 which is rotatable about an axis of rotation. By means of the contact strip, the rocker 31 is moved against the force of a tension spring and thus allows for controlled unwinding of the contact strip. Preferably, a brake at the roll mounting is adjusted in such a way that the tractive force exerted by the contact feed of the crimping tool is not able to turn the contact roll (see the subsequent description of FIG. 4). As a result, every crimping process further tightens the contact strip and, correspondingly, moves the rocker 31. If a sensor 34, for example, designed as a light barrier, detects that the rocker has reached a predetermined position, the drive of the winder is activated until the contact strip relaxes again. A second sensor (not shown) is able to detect that the contact strip is soon depleted. As a result of the spring effect, the rocker 31 moves to the stop position because the contact strip ran out of the empty supply roll and the brake is no longer activated.

Figure 4:
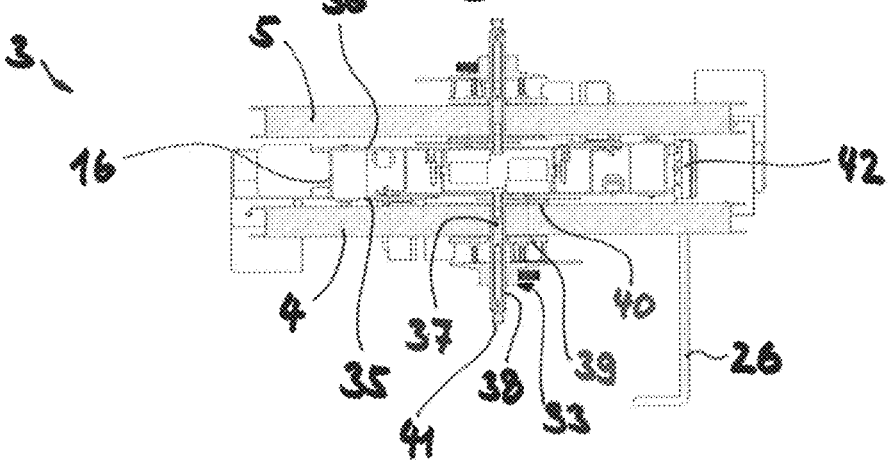
FIG. 4 is a cross-section through the supply rolls of the mobile supply unit (section B-B shown in FIG. 3)

FIG. 4 shows structural details regarding the arrangement of rotatably mounting the supply rolls 4, 5 in the mobile supply unit 3. The mobile supply unit 3 comprises two roll mountings 33 for an independent support of the supply rolls 4, 5, each of which supplies the contact strips. Each of the two roll mountings 33 has a bearing pin 37 designed as a retaining bolt, to which the respective supply roll can be attached laterally. The vertically extending support member 16 has opposite sidewalls 35, 36 to which the bearing pins 37, which protrude away from one another, are attached. A brake flange 39 pressed against the supply roll by spring force ensures, respectively, that the contact strip remains tight when pulled. By turning an adjusting screw 41, the counter flange 40 and a holding sleeve 38 can be moved in axial direction of the bearing pin or retaining bolt 37, in order to be able to precisely adjust the position of the carrier strip in relation to the contact feed of the crimping tool. The possibility to access the supply rolls from different sides ensures that without stopping the machine a new supply roll can be mounted easily on the inactive side during an ongoing crimping process.

The mobile supply unit 3 allows for local set-up (i.e., the supply of crimp contacts not currently in use is retooled at the machine), as well as for preparing a new mobile supply unit at a separate set-up station (for example, set-up space). The device can be mechanically (for example, using a cover for the active contact supply) designed in such a way that the exchange of crimp contacts can be performed only during active contact supply. In this way it can be ensured that by monitoring the quick connector the machine detects each exchange of the supply roll.

With the use of the unlocking lever 26 of the machine, the impact exerted on the latch of the coupling device by the quick connector can be stopped and, as a result, the supply unit can be disconnected.

Figure 5:
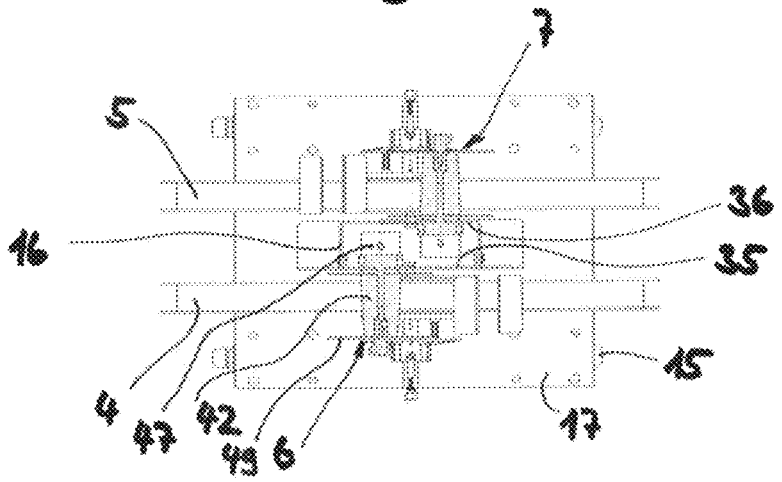
FIG. 5 is a cross-sectional display through the winders of the mobile supply unit (section A-A shown in FIG. 3)

The cross sectional display of FIG. 5 shows details about the structure of both winders 6, 7, wherein each winder is assigned to a supply roll 4, 5, respectively. The winder 6 (winder 7 is designed in the same manner) has a conical winding body 42 which can be actuated by means of an electric motor. Both winders 6, 7, respectively, for winding the carrier strips, which consist, for example, of paper, are actuated by electric motors 47, wherein a sensor system of the contact strip monitoring guarantees the motors is controlled. Both motors, respectively, can be actuated in such a way that the contact strips are rolled off through the traction on the paper webs. Preferably, the required electronic control is installed in the crimping press or the base machine. However, it is also possible to integrate said electronic control in the mobile supply unit. The paper web is rolled onto the winding body 42, which has a groove (not shown) for loading the paper web. To remove the paper it is only required to remove an attached cover 49. The winders are supported in such a way that they can be attached laterally, for example, analogous to the crimp contact supply rolls.

Figure 6:
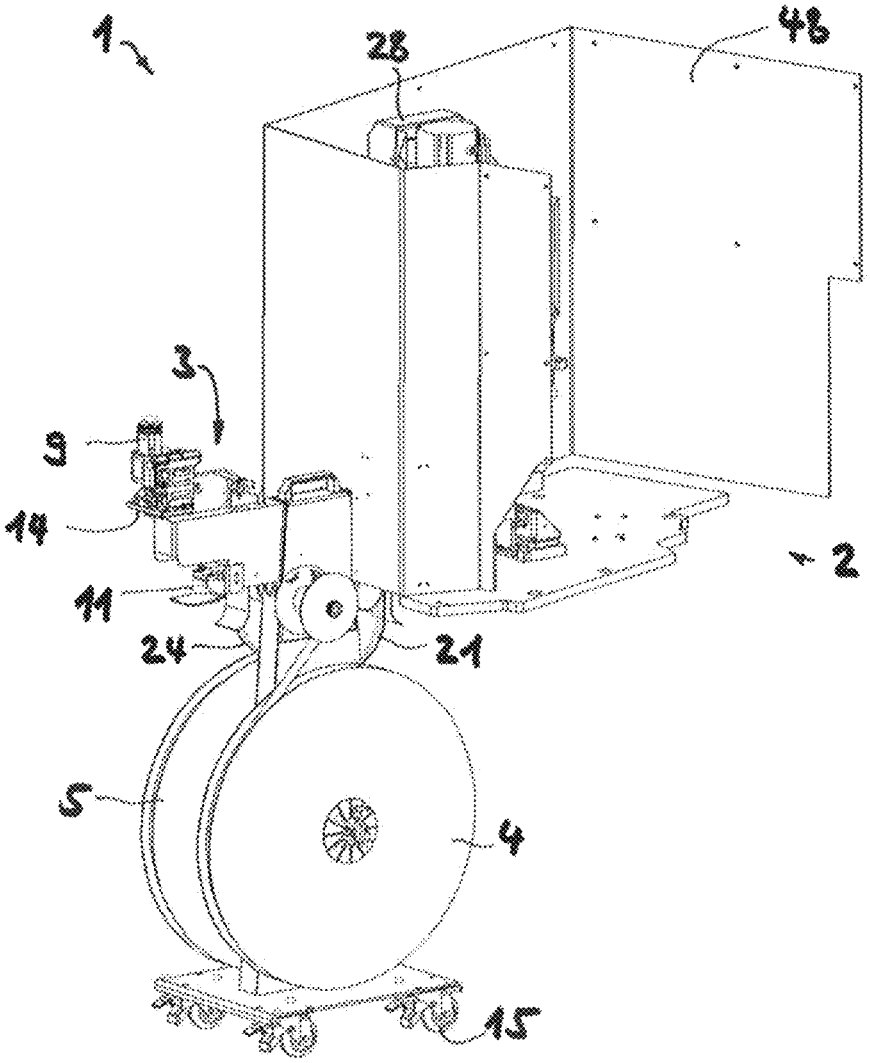
FIG. 6 is the device shown in FIG. 1 with a protective cover.

For personal protection the devices have to be usually secured with covers. FIG. 6 shows such a device 1 with a protective cover 48. Otherwise the device 1 corresponds to the device shown in FIG. 1. The special design of the mobile supply unit ensures that even during an operating phase, in which crimp connections are produced using the crimp contacts 21 from the supply roll 4, it is still possible to work on the opposite side which faces the supply roll 5. For example, an operator is able to thread the contact strip 24 of the supply roll 5 into the freely accessible crimping tool 9. In this way, the retooling work can be greatly simplified and the retooling times considerably reduced.

Figure 7:
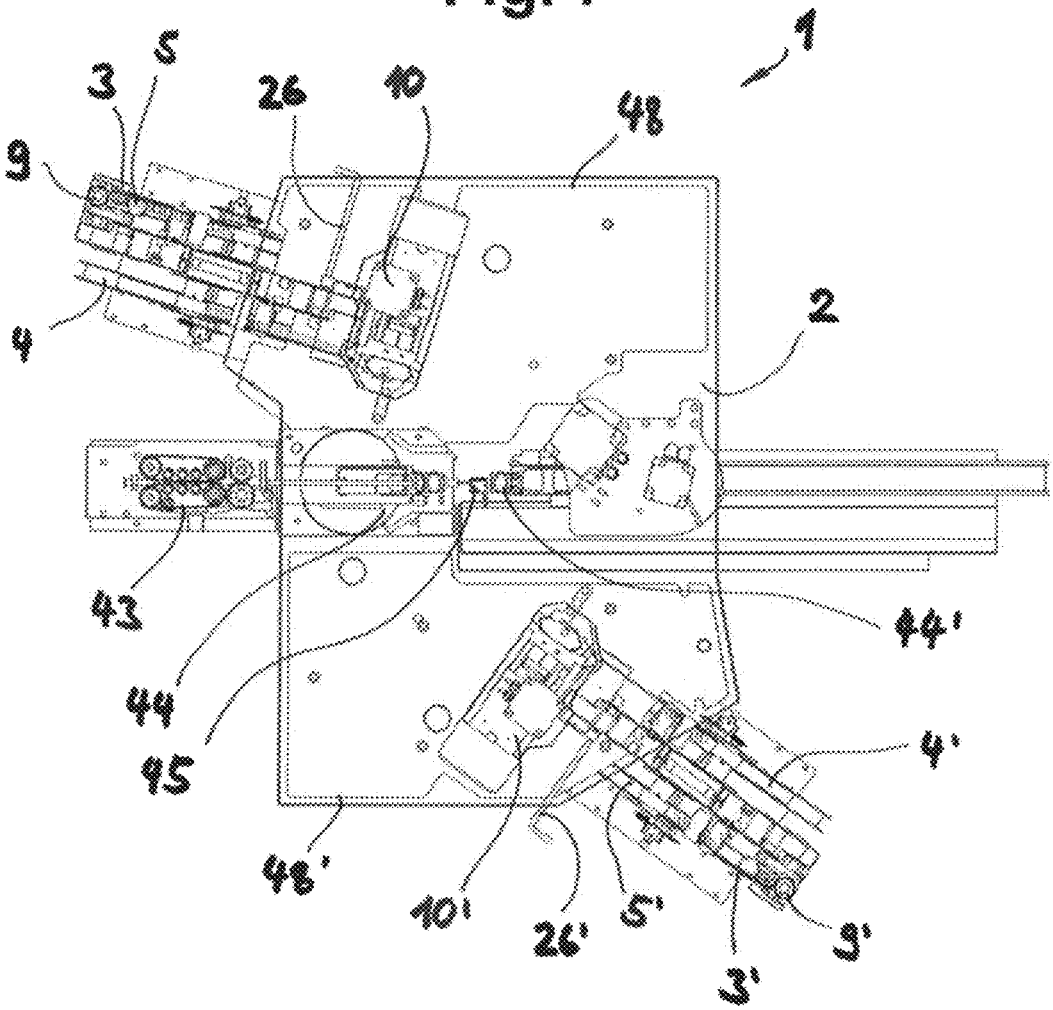
FIG. 7 is a top view on a further invention-base embodiment.

FIG. 7 shows a cable processing system with means of transport 43 designed, for example, as belt drive, for the cable feed, a stripping unit 45 for stripping a cable, two rotating and trigger mechanisms 44, 44' and two crimping presses 10, 10'. For example, the operating mode of the general arrangement is described in more detail in the patent document EP 2 442 413 A1. Both mobile supply units 3, 3' are arranged in such a way that the crimping tools 9, 9' and supply rolls 5, 5' not used for crimping are outside of the protective cover and therefore accessible for the operator when the crimping presses 10, 10' are running.

The crimping press station 2 shown in FIG. 7 comprises two crimping presses 10, 10'. It is possible to connect two mobile supply units 3, 3' to the crimping press station, wherein each supply unit 3, 3' is assigned to one crimping press 10, 10', respectively. The top view of the embodiment displayed in FIG. 7 shows that the contact strips can be removed from the supply rolls 4, 5 or 4', 5' in opposite conveying direction. Furthermore, FIG. 7 shows that in addition to the crimping press station 2 the device 1 can also comprise a stripping unit 45. The device 1 comprises a crimping press station 2 with two crimping presses 10, 10'.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for producing a crimp connection comprising the steps of:

connecting a mobile supply unit for storing and supplying crimp contacts to a crimping press station in a first docking location;

operating the crimping the crimping press station to connect conductor ends of cables with the crimp contacts from a first supply roll of the mobile supply unit, the crimp contacts being guided to the crimping press station as a contact strip with the crimp contacts strung together;

loading the mobile supply unit with a second supply roll for storing and supplying the crimp contacts; and disconnecting the mobile supply unit from first docking location at the crimping press station, connecting the mobile supply unit to the crimping press station in a second docking location and operating the crimping press station to connect conductor ends of cables with the crimp contacts from the second supply roll.

2. The method according to claim 1 wherein for transferring the mobile supply unit from the first docking location to the second docking location the mobile supply unit has transport wheels.

3. The method according to claim 1 including extracting the crimp contacts from the first and second supply rolls on the mobile supply unit.

4. The method according to claim 1 wherein the mobile supply unit is selectively movable between the two docking locations at the crimping press station wherein in each of the docking locations an associated one of the first and second supply rolls supplies the crimp contacts to the crimping press station.

5. The method according to claim 1 wherein the mobile supply unit has two roll mountings for rotatably mounting the first and second supply rolls.

6. The method according to claim 1 wherein the mobile supply unit includes two motor-driven winders and including winding up a carrier strip removed from the contact strip of the crimp contacts, wherein each of the winders is associated with a respective one of the first and second supply rolls.

7. The method according to claim 1 wherein the mobile supply unit includes for each of the first and second supply rolls a coupling device for docking or connecting to one of the first and second docking locations at the crimping press station and wherein the crimping press station has an unlocking lever for unlocking the coupling devices.

* * * * *